US010741915B2

(12) United States Patent
Chen et al.

(10) Patent No.: US 10,741,915 B2
(45) Date of Patent: Aug. 11, 2020

(54) ANTENNA STRUCTURE AND MOBILE DEVICE

(71) Applicant: Wistron NeWeb Corp., Hsinchu (TW)

(72) Inventors: Wei-Chen Chen, Hsinchu (TW); Cheng-Wei Chang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 13 days.

(21) Appl. No.: 16/278,340

(22) Filed: Feb. 18, 2019

(65) Prior Publication Data

US 2020/0185831 A1 Jun. 11, 2020

(30) Foreign Application Priority Data

Dec. 5, 2018 (TW) ..... 107143591 A

(51) Int. Cl.

| | |
|---|---|
| ***H01Q 1/24*** | (2006.01) |
| ***H01Q 5/328*** | (2015.01) |
| ***H01Q 5/335*** | (2015.01) |
| ***H01Q 9/30*** | (2006.01) |
| ***H01Q 13/10*** | (2006.01) |

(52) U.S. Cl.

CPC ..... *H01Q 5/328* (2015.01); *H01Q 1/243* (2013.01); *H01Q 5/335* (2015.01); *H01Q 9/30* (2013.01); *H01Q 13/10* (2013.01)

(58) Field of Classification Search

CPC ..... H01Q 1/24; H01Q 1/243; H01Q 1/245; H01Q 1/2291; H01Q 1/44; H01Q 1/48; H01Q 5/328; H01Q 5/378; H01Q 5/392; H01Q 13/10; H01Q 13/106; H01Q 9/30; H04B 1/18; H04B 1/0458

See application file for complete search history.

(56) References Cited

U.S. PATENT DOCUMENTS

| | | | | |
|---|---|---|---|---|
| 10,283,847 | B2 * | 5/2019 | Li | H01Q 1/2291 |
| 10,381,715 | B2 * | 8/2019 | Han | H01Q 1/245 |
| 10,490,902 | B2 * | 11/2019 | Yen | H01Q 5/342 |
| 2015/0022422 | A1 * | 1/2015 | Chang | H01Q 1/243 343/861 |

* cited by examiner

*Primary Examiner* — Haissa Philogene
(74) *Attorney, Agent, or Firm* — McClure, Qualey & Rodack, LLP

(57) ABSTRACT

An antenna structure includes a metal mechanism element, a ground element, a feeding radiation element, a coupling element, a dielectric substrate, and a switchable circuit. The metal mechanism element has a slot. The feeding radiation element extends across the slot. A coupling gap is formed between the feeding radiation element and the coupling element. The feeding radiation element and the coupling element are disposed on the dielectric substrate. The switchable circuit includes a first metal element, a second metal element, a reactance element, a capacitor, and a diode. The first metal element is coupled to the coupling element. The reactance element is embedded in the first metal element. The second metal element is coupled through the capacitor to the ground element. The diode is coupled between the first metal element and the second metal element. The diode is turned on or off according to the control voltage difference.

20 Claims, 9 Drawing Sheets

ANTENNA STRUCTURE AND MOBILE DEVICE

CROSS REFERENCE TO RELATED APPLICATIONS

This application claims priority of Taiwan Patent Application No. 107143591 filed on Dec. 5, 2018, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to an antenna structure including a metal mechanism element, a ground element, a feeding radiation element, a coupling element, a dielectric substrate, and a switchable circuit. The metal mechanism element has a slot. The ground element is coupled to the metal mechanism element. The feeding radiation element is coupled to a signal source. The feeding radiation element extends across the slot. The coupling element is disposed adjacent to the feeding radiation element. A coupling gap is formed between the feeding radiation element and the coupling element. The feeding radiation element and the coupling element are disposed on the dielectric substrate. The switchable circuit includes a first metal element, a second metal element, a reactance element, a capacitor, and a diode. The first metal element is coupled to the coupling element. The reactance element is embedded in the first metal element. The second metal element is coupled through the capacitor to the ground element. The diode is coupled between the first metal element and the second metal element. The diode is turned on or turned off according to the control voltage difference.

In another exemplary embodiment, the disclosure is directed to an antenna structure including a metal mechanism element, a ground element, a feeding radiation element, a coupling element, a dielectric substrate, and a switchable circuit. The metal mechanism element has a slot. The ground element is coupled to the metal mechanism element. The feeding radiation element is coupled to a signal source. The feeding radiation element extends across the slot. The coupling element is disposed adjacent to the feeding radiation element. A coupling gap is formed between the feeding radiation element and the coupling element. The feeding radiation element and the coupling element are disposed on the dielectric substrate. The switchable circuit includes a first metal element, a second metal element, a first resistor, a second resistor, and a BJT (Bipolar Junction Transistor). The first metal element is coupled to the coupling element. The first resistor is embedded in the first metal element. The second resistor is embedded in the second metal element. The BJT is operated according to the control voltage difference. The BJT has an emitter coupled to the ground element, a base coupled to the second metal element, and a collector coupled to the first metal element.

In another exemplary embodiment, the disclosure is directed to a mobile device including a metal mechanism element, a ground element, a feeding radiation element, a coupling element, a dielectric substrate, and a switchable circuit. The metal mechanism element has a slot. The ground element is coupled to the metal mechanism element. The feeding radiation element is coupled to a signal source. The feeding radiation element extends across the slot. The coupling element is disposed adjacent to the feeding radiation element. A coupling gap is formed between the feeding radiation element and the coupling element. The feeding radiation element and the coupling element are disposed on the dielectric substrate. The switchable circuit includes a first metal element, a second metal element, an inductor, a capacitor, and a diode. The first metal element is coupled to the coupling element. The inductor is embedded in the first metal element. The second metal element is coupled through the capacitor to the ground element. The diode is coupled between the first metal element and the second metal element. The diode is turned on or turned off according to the control voltage difference. An antenna structure is formed by the metal mechanism element, the ground element, the feeding radiation element, the coupling element, the dielectric substrate, and the switchable circuit.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to...". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
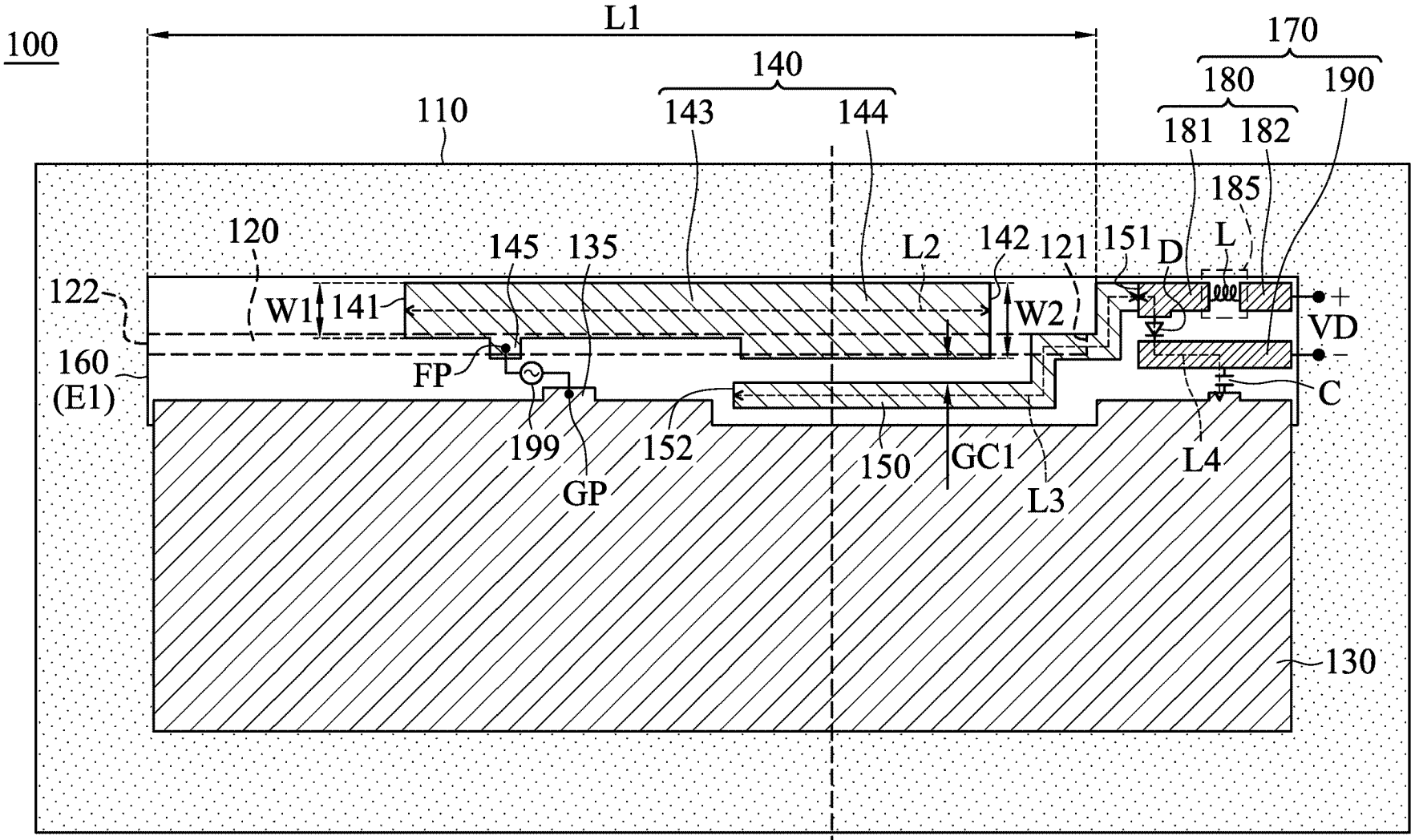
FIG. 1A is a top view of an antenna structure according to an embodiment of the invention.
Figure 1B:
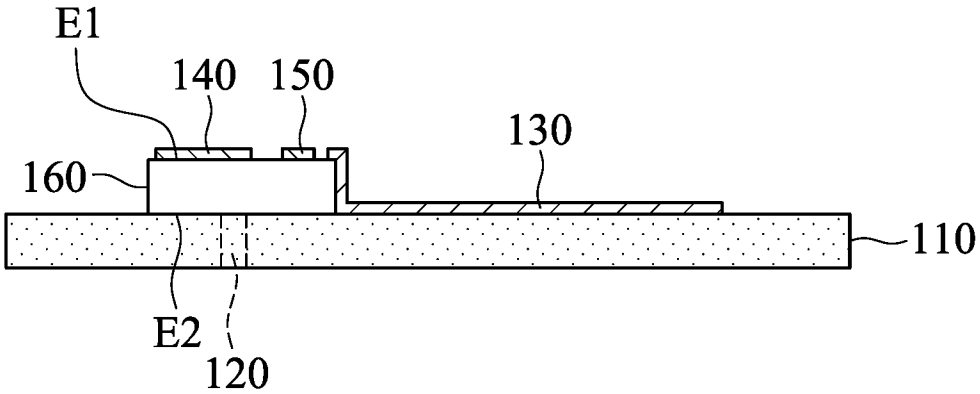
FIG. 1B is a sectional view of an antenna structure according to an embodiment of the invention.

FIG. 1A is a top view of an antenna structure 100 according to an embodiment of the invention. FIG. 1B is a sectional view of the antenna structure 100 according to an embodiment of the invention (along a sectional line LC1 of FIG. 1A). Please refer to FIG. 1A and FIG. 1B together. The antenna structure 100 may be applied in a mobile device, such as a smartphone, a tablet computer, or a notebook computer. In the embodiment of FIG. 1A and FIG. 1B, the antenna structure 100 at least includes a metal mechanism element 110, a ground element 130, a feeding radiation element 140, a coupling element 150, a dielectric substrate 160, and a switchable circuit 170. The ground element 130, the feeding radiation element 140, and the coupling element 150 may be made of metal materials, such as copper, silver, aluminum, iron, or their alloys.

The metal mechanism element 110 may be a metal housing of the mobile device. In some embodiments, the metal mechanism element 110 is a metal upper cover of a notebook computer or a metal back cover of a tablet computer, but it is not limited thereto. The metal mechanism element 110 has a slot 120. The slot 120 of the metal mechanism element 110 may substantially have a straight-line shape. Specifically, the slot 120 is a closed slot with a first closed end 121 and a second closed end 122 which are away from each other. The antenna structure 100 may further include a nonconductive material, which fills the slot 120 of the metal mechanism element 110.

The dielectric substrate 160 may be an FR4 (Flame Retardant 4) substrate, a PCB (Printed Circuit Board), or an FCB (Flexible Circuit Board). The dielectric substrate 160 has a first surface El and a second surface E2 which are opposite to each other. The feeding radiation element 140 and the coupling element 150 are both disposed on the first surface El of the dielectric substrate 160. The second surface E2 of the dielectric substrate 160 is adjacent to the slot 120 of the metal mechanism element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second surface E2 of the dielectric substrate 160 is directly attached to the metal mechanism element 110, and the dielectric substrate 160 extends across the slot 120 of the metal mechanism element 110. The ground element 130 may be a ground copper foil, which may substantially have a stepped-shape (as shown in FIG. 1B). For example, the ground element 130 may be coupled to the metal mechanism element 110, and the ground element 130 may extend from the metal mechanism element 110 onto the first surface El of the dielectric substrate 160.

The feeding radiation element 140 may substantially have a straight-line shape. The feeding radiation element 140 has a feeding point FP, which may be coupled to a signal source 199. For example, the signal source 199 may be an RF (Radio Frequency) module, and the feeding radiation element 140 may extend across the slot 120 of the metal mechanism element 110, so as to excite the antenna structure 100. The feeding radiation element 140 has a first end 141 and a second end 142 which are away from each other. The first end 141 and the second end 142 of the feeding radiation element 140 are two open ends. In some embodiments, the feeding radiation element 140 has a variable-width structure. For example, the feeding radiation element 140 includes a narrow portion 143 and a wide portion 144. The narrow portion 143 is adjacent to the first end 141 of the feeding radiation element 140. The wide portion 144 is adjacent to the second end 142 of the feeding radiation element 140. Specifically, the wide portion 144 of the feeding radiation element 140 has a vertical projection on the metal mechanism element 110, and the vertical projection at least partially overlaps the slot 120. In addition, the narrow portion 143 of the feeding radiation element 140 has a vertical projection on the metal mechanism element 110, and the vertical projection may at least partially overlap the slot 120, or may not overlap the slot 120 at all. In some embodiments, the feeding radiation element 140 further includes a first protruding portion 145 coupled to the narrow portion 143, and the ground element 130 further includes a second protruding portion 135. The first protruding portion 145 and the second protruding portion 135 may extend toward each other. Each of the first protruding portion 145 and the second protruding portion 135 may substantially have a rectangular shape or a square shape. In some embodiments, the feeding point FP is positioned on the first protruding portion 145 of the feeding radiation element 140 and is coupled to a positive electrode of the signal source 199, and a grounding point GP is positioned on the second protruding portion 135 of the ground element 130 and is coupled to a negative electrode of the signal source 199. It should be noted that the above first protruding portion 145 and second protruding portion 135 are optional elements, and they are omitted in other embodiments.

The coupling element 150 may have a meandering structure. For example, the coupling element 150 may substantially have a W-shape, but it is not limited thereto. The coupling element 150 is disposed adjacent to the feeding radiation element 140. A coupling gap GC1 may be formed between the wide portion 144 of the feeding radiation element 140 and the coupling element 150. Specifically, the coupling element 150 has a first end 151 and a second end 152. The first end 151 of the coupling element 150 is coupled to the switchable circuit 170. The second end 152 of the coupling element 150 is an open end, which extends between the feeding radiation element 140 and the ground element 130. In some embodiments, the coupling element 150 has a vertical projection on the metal mechanism element 110, and the vertical projection at least partially overlaps the first closed end 121 of the slot 120, so as to fine-tune the impedance matching of the antenna structure 100.

The switchable circuit 170 includes a first metal element 180, a second metal element 190, a reactance element 185, a capacitor C, and a diode D. The first metal element 180 may substantially have a straight-line shape. The first metal element 180 includes a first portion 181 and a second portion 182. The first portion 181 of the first metal element 180 is coupled to the first end 151 of the coupling element 150. The reactance element 185 is embedded in the first metal element 180. The reactance element 185 is coupled in series between the first portion 181 and the second portion 182 of the first metal element 180. For example, the reactance circuit 185 may include an inductor L, which may be a fixed inductor or a variable inductor, but it is not limited thereto. The second metal element 190 may substantially have a straight-line shape. The second metal element 190 may be substantially parallel to the first metal element 180. A median portion of the second metal element 190 is coupled through the capacitor C to the ground element 130. In some embodiments, the antenna structure 100 further includes a voltage generator (not shown) for generating and adjusting the control voltage difference VD according to a processor instruction. The first metal element 180 and the second metal element 190 are configured to receive the control voltage difference VD. The diode D is coupled between the first metal element 180 and the second metal element 190. The diode D is turned on or turned off according to the control voltage difference VD. Specifically, the diode D has an anode and a cathode. The anode of the diode D is coupled to the first metal element 180. The cathode of the diode D is coupled to the second metal element 190. However, the invention is not limited thereto. In other embodiments, adjustments are made such that the anode of the diode D is coupled to the second metal element 190, and the cathode of the diode D is coupled to the first metal element 180. The polarities of the control voltage difference VD may be changed correspondingly.

Figure 2A:
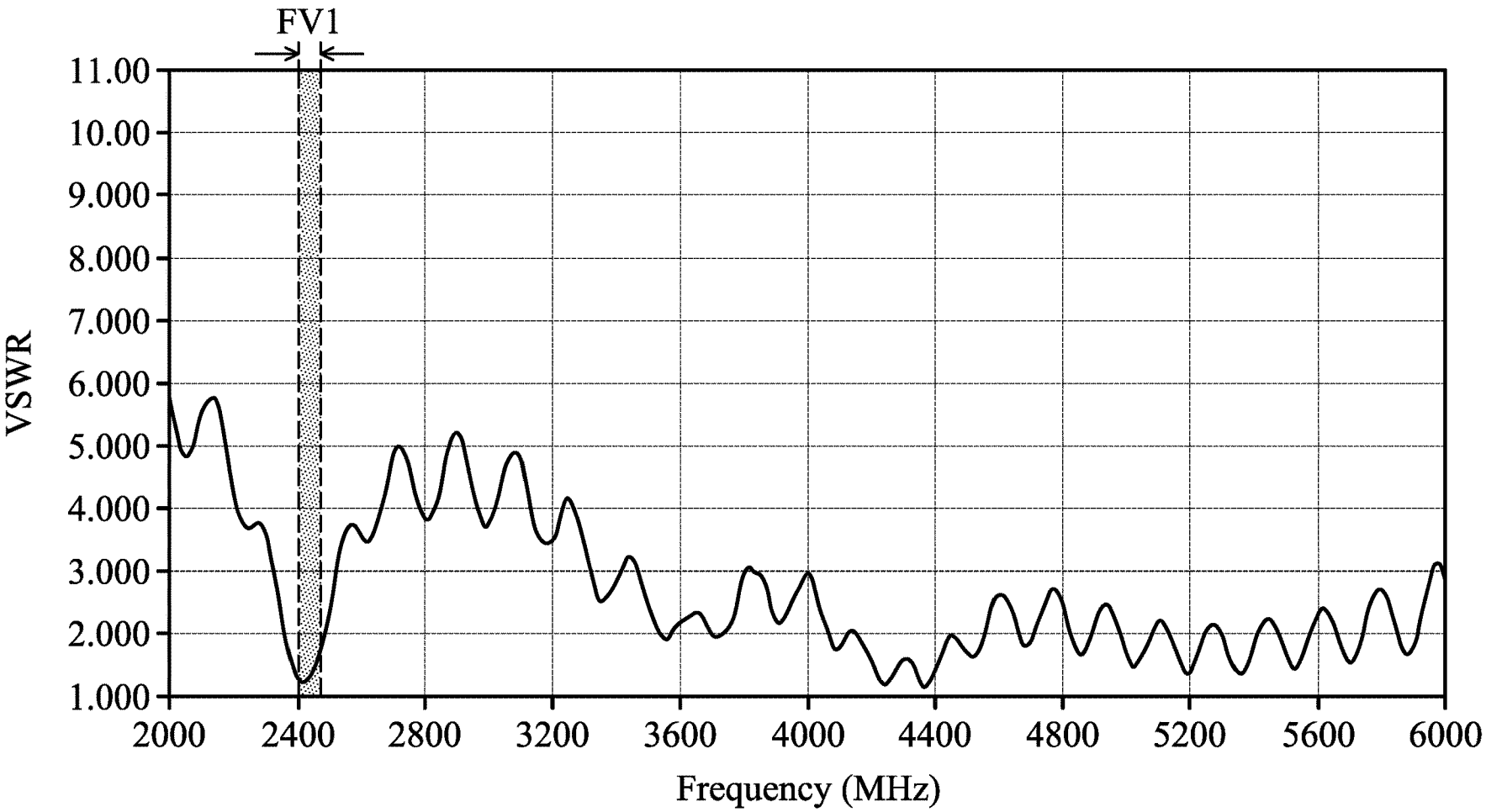
FIG. 2A is a diagram of VSWR (Voltage Standing Wave Ratio) of an antenna structure according to an embodiment of the invention.
Figure 2B:
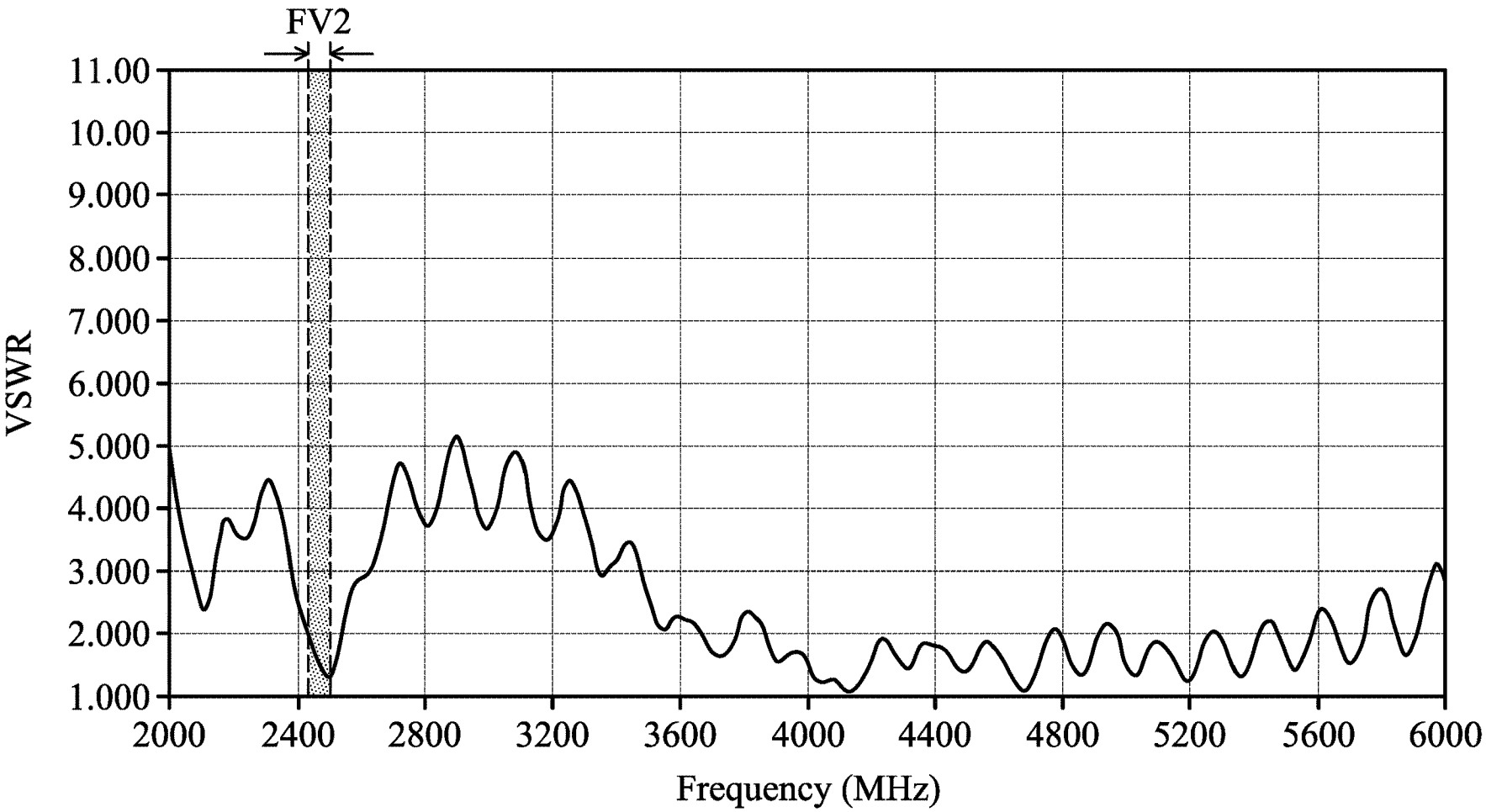
FIG. 2B is a diagram of VSWR of an antenna structure according to another embodiment of the invention.

FIG. 2A is a diagram of VSWR (Voltage Standing Wave Ratio) of the antenna structure 100 according to an embodiment of the invention. In the embodiment of FIG. 2A, when the control voltage difference VD becomes smaller (e.g., the control voltage difference VD may be equal to 0V), the diode D is turned off and the antenna structure 100 covers a first frequency interval FV1. FIG. 2B is a diagram of VSWR of the antenna structure 100 according to another embodiment of the invention. In the embodiment of FIG. 2B, when the control voltage difference VD becomes larger (e.g., the control voltage difference VD may be larger than 1.5V), the diode D is turned on and the antenna structure 100 covers a second frequency interval FV2 which is higher than the first frequency interval FV1. For example, the first frequency interval FV1 may be from 2400 MHz to 2470 MHz, and the second frequency interval FV2 may be from 2430 MHz to 2500 MHz. According to the measurements of FIG. 2A and FIG. 2B, the antenna structure 100 as a whole covers an operation frequency band, which may be from 2400 MHz to 2500 MHz and/or from 5150 MHz to 5850 MHz. Therefore, the antenna structure 100 can support the wideband operations of WLAN (Wireless Local Area Networks) 2.4 GHz/5 GHz. The switchable circuit 170 is mainly configured to increase the low-frequency operation bandwidth of the antenna structure 100.

In some embodiments, the operation principles of the antenna structure 100 may be as follows. The metal mechanism element 110 and its slot 120 are excited by the feeding radiation element 140, thereby forming the aforementioned operation frequency band. A mutual coupling effect is induced between the coupling element 150 and the feeding radiation element 140, and it is used to fine-tune the range of the aforementioned operation frequency band. According to practical measurements, when the diode D is turned off, the coupling element 150 is floating and provides a shorter coupling length, such that the first frequency interval FV1 becomes lower; and when the diode D is turned on, the coupling element 150 is grounded and provides a longer coupling length, such that the second frequency interval FV2 becomes higher. For the antenna structure 100, the capacitor C is considered as a short-circuited path for blocking low-frequency grounding noise, and the inductor L is considered as an open-circuited path for blocking high-frequency resonant currents. Furthermore, the first protruding portion 145 of the feeding radiation element 140 and the second protruding portion 135 of the ground element 130 help to reduce the difficulty of manufacturing and soldering the antenna structure 100. If the first protruding portion 145 and the second protruding portion 135 are omitted, the feeding point FP may be moved onto any edge of the feeding radiation element 140, and the grounding point GP may be moved onto any edge of the ground element 130, without affecting the performance of the invention.

Figure 3:
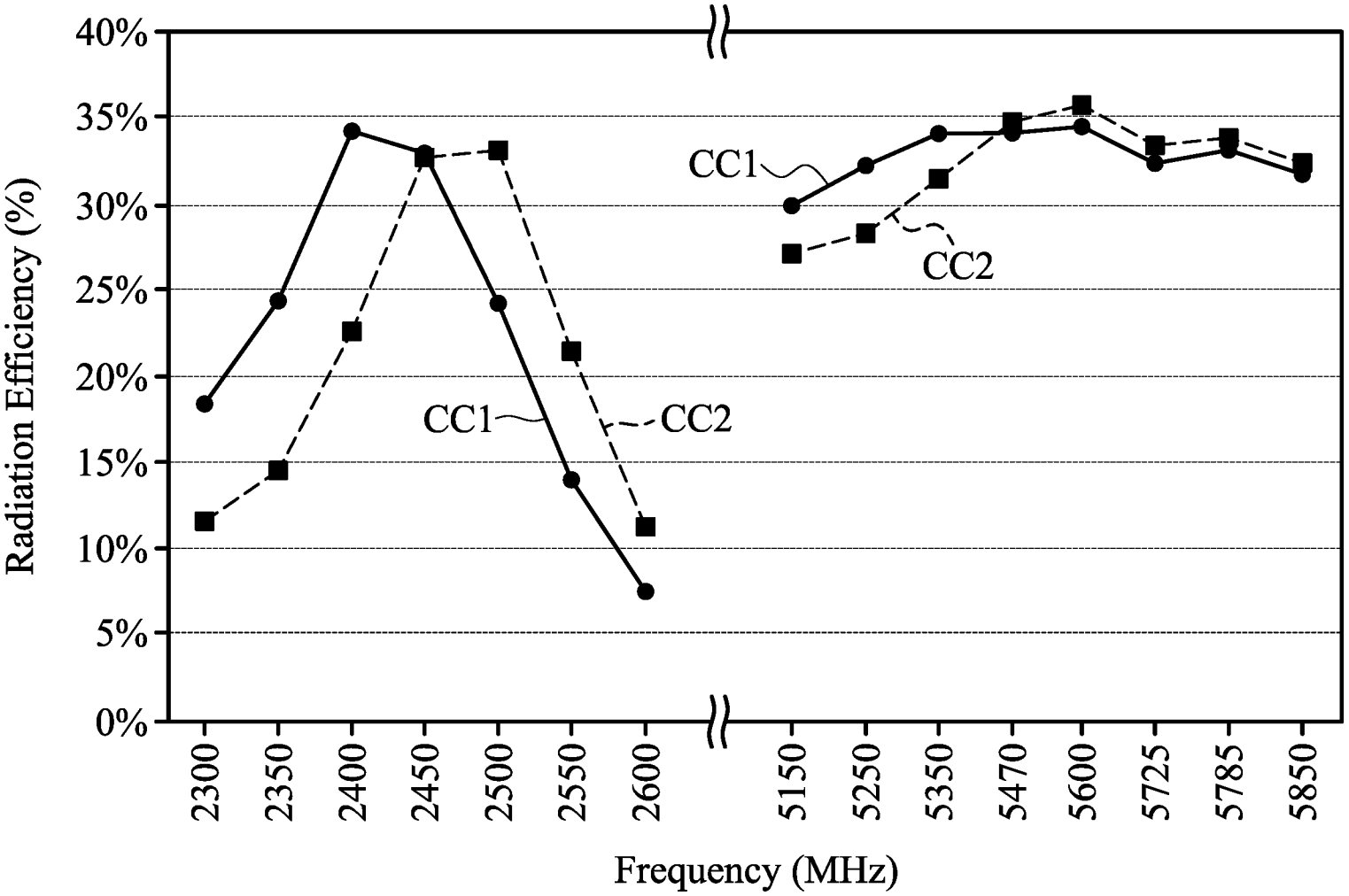
FIG. 3 is a diagram of radiation efficiency of an antenna structure according to an embodiment of the invention.

FIG. 3 is a diagram of radiation efficiency of the antenna structure 100 according to an embodiment of the invention. A first curve CC1 represents the radiation efficiency of the antenna structure 100 when the diode D is turned off. A second curve CC2 represents the radiation efficiency of the antenna structure 100 when the diode D is turned on. According to the measurement of FIG. 3, within the above operation frequency band (e.g., from 2400 MHz to 2500 MHz, and from 5150 MHz to 5850 MHz), the radiation efficiency of the antenna structure 100 can reach 30% or higher, and it can meet the requirements of practical application of general mobile communication devices.

In some embodiments, the element sizes of the antenna structure 100 are described as follows. The length L1 of the slot 120 (i.e., the length L1 from the first closed end 121 to the second closed end 122) may be substantially equal to 0.5 wavelength (λ/2) of the lowest frequency (e.g., 2400 MHz) of the operation frequency band of the antenna structure 100. The length L2 of the feeding radiation element 140 (i.e., the length L2 from the first end 141 to the second end 142) may be substantially equal to 0.25 wavelength (λ/4) of the lowest frequency of the operation frequency band of the antenna structure 100. Among the feeding radiation element 140, the width W2 of the wide portion 144 may be 1 to 2 times (e.g., 1.5 times) the width W1 of the narrow portion 143. The length L3 of the coupling element 150 (i.e., the length L3 from the first end 151 to the second end 152) may be substantially equal to 0.25 wavelength (λ/4) of the lowest frequency of the operation frequency band of the antenna structure 100. The width of the coupling gap GC1 may be from 0 mm to 3 mm (e.g., 1 mm). In addition, a switchable grounding path is formed from the first portion 181 of the first metal element 180 through the diode D, the second metal element 190, and the capacitor C to the ground element 130, and the length L4 of the switchable grounding path may be substantially equal to 0.25 wavelength (λ/4) of the lowest frequency of the operation frequency band of the antenna structure 100. Thus, when the diode D is turned on, the total coupling length of the coupling element 150 is considered as a sum of the above length L3 and length L4, that is, 0.5 wavelength (λ/2) of the lowest frequency of the operation frequency band of the antenna structure 100. The inductance of the inductor L may be from 100 nH to 200 nH (e.g., 120 nH). The capacitance of the capacitor C may be from 2 pF to 3 pF (e.g., 2.7 pF). The cut-in voltage of the diode D may be about 0.7V. The above ranges of parameters are calculated and obtained according to many experiment results, and they help to optimize the operation bandwidth and impedance matching of the antenna structure 100.

Figure 4:
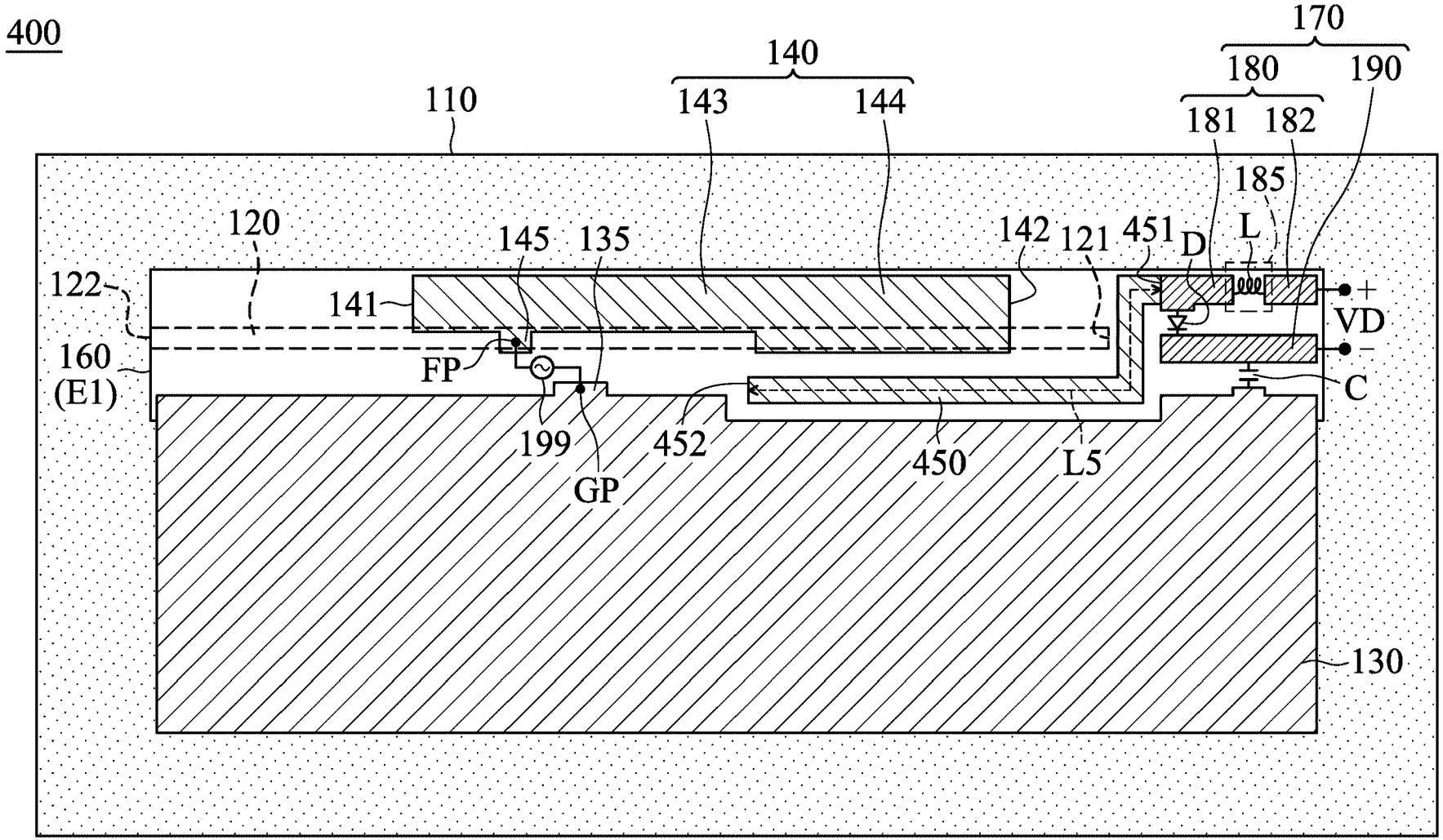
FIG. 4 is a top view of an antenna structure according to another embodiment of the invention.

FIG. 4 is a top view of an antenna structure 400 according to another embodiment of the invention. FIG. 4 is similar to FIG. 1A. In the embodiment of FIG. 4, a coupling element 450 of the antenna structure 400 substantially has a simple L-shape. The coupling element 450 has a first end 451 and a second end 452. The first end 451 of the coupling element 450 is coupled to the first metal element 180 of the switchable circuit 170. The second end 452 of the coupling element 450 is an open end, which extends between the feeding radiation element 140 and the ground element 130. The length L5 of the coupling element 450 may be substantially equal to 0.25 wavelength (λ/4) of the lowest frequency of the operation frequency band of the antenna structure 400. According to practical measurement, even if the coupling element 450 does not have a complex meandering structure, the antenna structure 400 can still support the above wideband operations. Other features of the antenna structure 400 of FIG. 4 are similar to those of the antenna structure 100 of FIG. 1A and FIG. 1B. Therefore, the two embodiments can achieve similar levels of performance.

Figure 5:
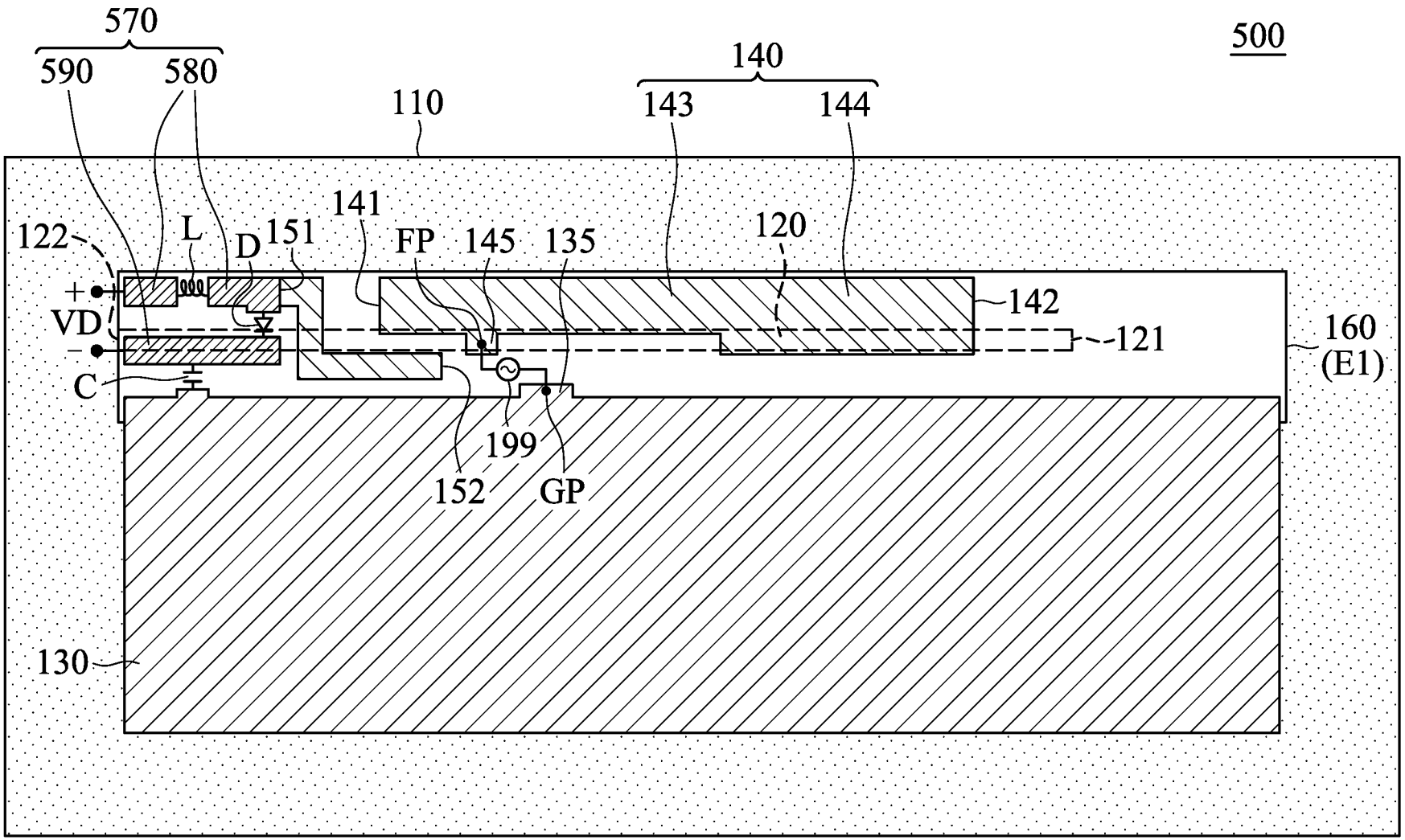
FIG. 5 is a top view of an antenna structure according to another embodiment of the invention.

FIG. 5 is a top view of an antenna structure 500 according to another embodiment of the invention. FIG. 5 is similar to FIG. 1A. In the embodiment of FIG. 5, a switchable circuit 570 of the antenna structure 500 includes a first metal element 580, a second metal element 590, an inductor L, a capacitor C, and a diode D, and their connections are similar to the switchable circuit 170 of FIG. 1A. The main difference from the embodiment of FIG. 1A is that the switchable circuit 570 is disposed adjacent to the narrow portion 143 of the feeding radiation element 140, rather than the wide portion 144 of the feeding radiation element 140. With such a design, the operation frequency band from 5150 MHz to 5850 MHz is also adjustable by switching the diode D, thereby increasing the high-frequency operation bandwidth of the antenna structure 500. Other features of the antenna structure 500 of FIG. 5 are similar to those of the antenna structure 100 of FIG. 1A and FIG. 1B. Therefore, the two embodiments can achieve similar levels of performance.

Figure 6:
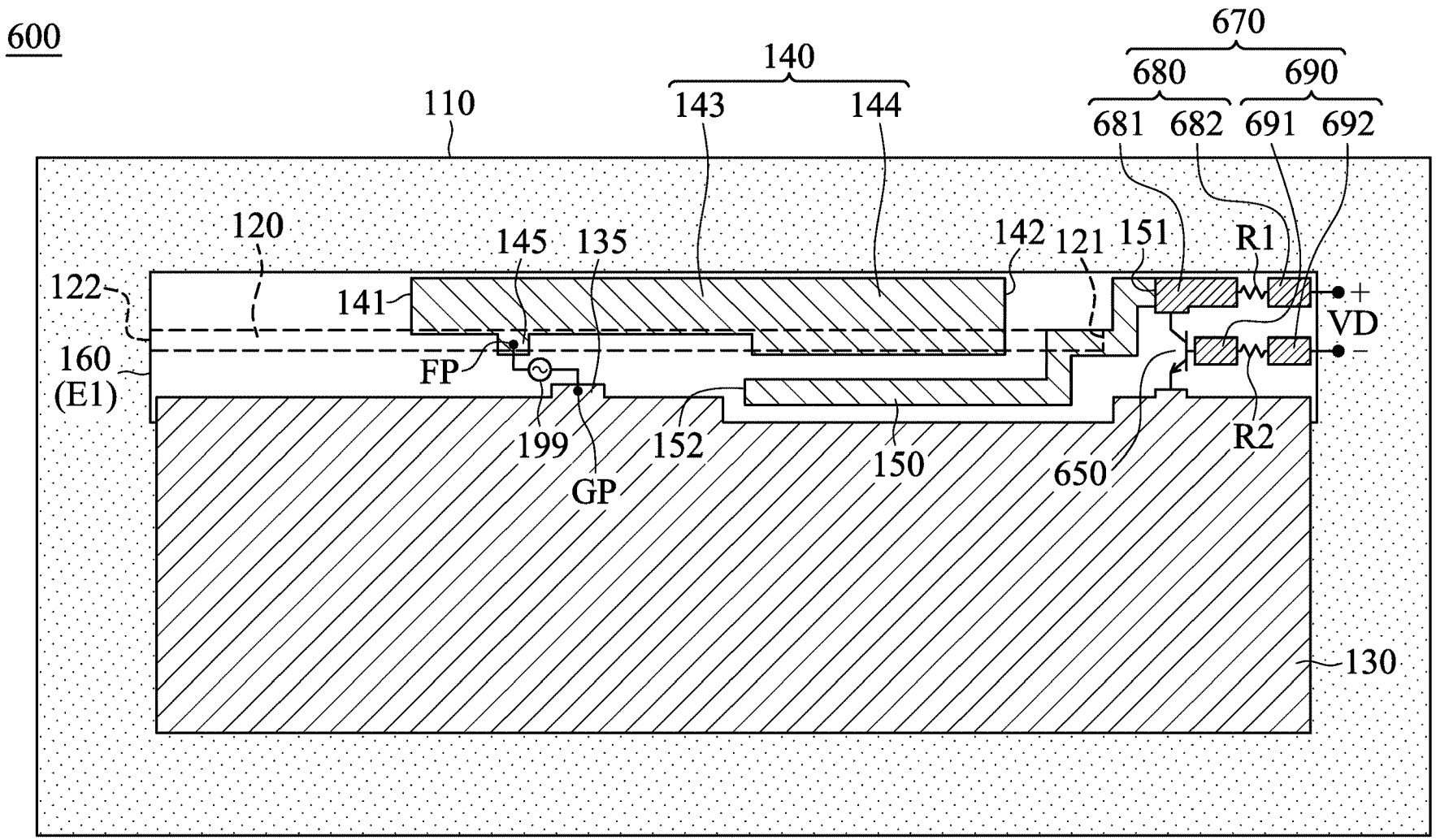
FIG. 6 is a top view of an antenna structure according to another embodiment of the invention.

FIG. 6 is a top view of an antenna structure 600 according to another embodiment of the invention. FIG. 6 is similar to FIG. 1A. In the embodiment of FIG. 6, a switchable circuit 670 of the antenna structure 600 includes a first metal element 680, a second metal element 690, a first resistor R1, a second resistor R2, and a BJT (Bipolar Junction Transistor) 650. The first metal element 680 may substantially have a straight-line shape. The first metal element 680 includes a first portion 681 and a second portion 682. The first portion 681 of the first metal element 680 is coupled to the first end 151 of the coupling element 150. The first resistor R1 is embedded in the first metal element 680. The first resistor R1 is coupled in series between the first portion 681 and the second portion 682 of the first metal element 680. The second metal element 690 may substantially have a straight-line shape. The second resistor R2 is embedded in the second metal element 690. The second resistor R2 is coupled in series between a first portion 691 and a second portion 692 of the second metal element 690. The first metal element 680 and the second metal element 690 are configured to receive the above control voltage difference VD. The BJT 650 may be NPN-type, and it can be operated according to the control voltage difference VD. Specifically, the BJT 650 has an emitter, a base, and a collector. The emitter of the BJT 650 is coupled to the ground element 130. The base of the BJT 650 is coupled to the first portion 691 of the second metal element 690. The collector of the BJT 650 is coupled to the first portion 681 of the first metal element 680. However, the invention is not limited thereto. In other embodiments, adjustments are made such that the BJT 650 is PNP-type, and the polarities of the control voltage difference VD are changed correspondingly. The resistance of the first resistor R1 may be from 0 Ω to 1000 kΩ, such as 100 kΩ. The resistance of the second resistor R2 may be from 0 Ω to 1000 kΩ, such as 1 kΩ. With such a design, the BJT 650 can selectively couple the first metal element 680 to the second metal element 690 according to the control voltage difference VD, and the first resistor R1 and the second resistor R2 can suppress low-frequency grounding noise and high-frequency resonant currents. Other features of the antenna structure 600 of FIG. 6 are similar to those of the antenna structure 100 of FIG. 1A and FIG. 1B. Therefore, the two embodiments can achieve similar levels of performance.

Figure 7:
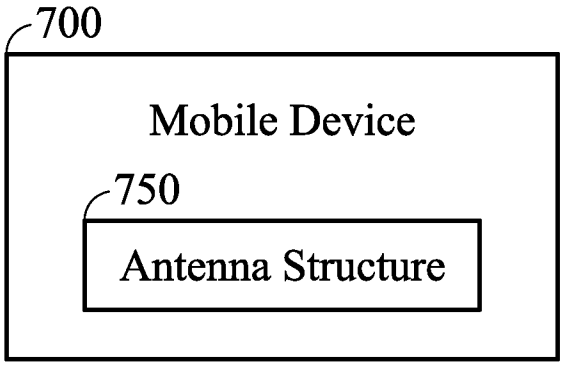
FIG. 7 is a diagram of a mobile device according to an embodiment of the invention.

FIG. 7 is a diagram of a mobile device 700 according to an embodiment of the invention. In the embodiment of FIG. 7, the mobile device 700 includes an antenna structure 750, which may be the antenna structure described in any embodiment of FIGS. 1 to 6. For example, the mobile device 700 may be integrated with the above antenna structure, and it may be a smartphone, a tablet computer, or a notebook computer, but not limited thereto.

The invention proposes a novel antenna structure, which uses a single slot and a switchable circuit for covering wideband operations. When the antenna structure is applied to a mobile device including a metal mechanism element, the metal mechanism element does not negatively affect the radiation performance of the antenna structure because the metal mechanism element is considered as an extension portion of the antenna structure. It should be also noted that the invention can improve the appearance and design of the mobile device, without opening any antenna windows on the metal mechanism element. In conclusion, the invention has at least the advantages of small size, wide bandwidth, and beautiful device appearance, and therefore it is suitable for application in a variety of mobile communication devices with narrow borders.

Note that the above element sizes, element shapes, and frequency ranges are not limitations of the invention. An antenna designer can fine-tune these settings or values according to different requirements. It should be understood that the antenna structure and the mobile device of the invention are not limited to the configurations of FIGS. 1-7. The invention may merely include any one or more features of any one or more embodiments of FIGS. 1-7. In other words, not all of the features displayed in the figures should be implemented in the antenna structure and the mobile device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a metal mechanism element, having a slot;

a ground element, coupled to the metal mechanism element;

a feeding radiation element, coupled to a signal source, wherein the feeding radiation element extends across the slot;

a coupling element, disposed adjacent to the feeding radiation element, wherein a coupling gap is formed between the feeding radiation element and the coupling element;

a dielectric substrate, wherein the feeding radiation element and the coupling element are disposed on the dielectric substrate; and a switchable circuit, comprising:

a first metal element, coupled to the coupling element;

a reactance element, embedded in the first metal element;

a second metal element;

a capacitor, wherein the second metal element is coupled through the capacitor to the ground element; and a diode, coupled between the first metal element and the second metal element, wherein the diode is turned on or turned off according to a control voltage difference.

2. The antenna structure as claimed in claim 1, wherein the metal mechanism element is a metal back cover of a mobile device.

3. The antenna structure as claimed in claim 1, wherein the slot is a closed slot with a first closed end and a second closed end.

4. The antenna structure as claimed in claim 1, wherein the ground element is a ground copper foil extending from the metal mechanism element onto the dielectric substrate.

5. The antenna structure as claimed in claim 1, wherein the feeding radiation element substantially has a straight-line shape.

6. The antenna structure as claimed in claim 1, wherein the feeding radiation element has a variable-width structure.

7. The antenna structure as claimed in claim 6, wherein the feeding radiation element comprises a narrow portion and a wide portion, the wide portion has a vertical projection on the metal mechanism element, and the vertical projection at least partially overlaps the slot.

8. The antenna structure as claimed in claim 7, wherein the feeding radiation element further comprises a first protruding portion coupled to a positive electrode of the signal source, and the ground element further comprises a second protruding portion coupled to a negative electrode of the signal source.

9. The antenna structure as claimed in claim 8, wherein the first protruding element of the feeding radiation element is coupled to the narrow portion of the feeding radiation element.

10. The antenna structure as claimed in claim 1, wherein the coupling element has a meandering structure.

11. The antenna structure as claimed in claim 1, wherein the diode has an anode coupled to the first metal element, and a cathode coupled to the second metal element.

12. The antenna structure as claimed in claim 1, wherein each of the first metal element and the second metal element substantially has a straight-line shape.

13. The antenna structure as claimed in claim 1, wherein the first metal element and the second metal element are configured to receive the control voltage difference.

14. The antenna structure as claimed in claim 1, wherein when the control voltage difference becomes smaller, the diode is turned off and the antenna structure covers a first frequency interval, and when the control voltage difference becomes larger, the diode is turned on and the antenna structure covers a second frequency interval which is higher than the first frequency interval.

15. The antenna structure as claimed in claim 1, wherein the antenna structure has an operation frequency band which is from 2400 MHz to 2500 MHz and/or from 5150 MHz to 5850 MHz.

16. The antenna structure as claimed in claim 15, wherein a length of the slot is substantially equal to 0.5 wavelength of the lowest frequency of the operation frequency band.

17. The antenna structure as claimed in claim 15, wherein a length of the feeding radiation element is substantially equal to 0.25 wavelength of the lowest frequency of the operation frequency band.

18. The antenna structure as claimed in claim 15, wherein a length of the coupling element is substantially equal to 0.25 wavelength of the lowest frequency of the operation frequency band.

19. An antenna structure, comprising:

a metal mechanism element, having a slot;

a ground element, coupled to the metal mechanism element;

a feeding radiation element, coupled to a signal source, wherein the feeding radiation element extends across the slot;

a coupling element, disposed adjacent to the feeding radiation element, wherein a coupling gap is formed between the feeding radiation element and the coupling element;

a dielectric substrate, wherein the feeding radiation element and the coupling element are disposed on the dielectric substrate; and a switchable circuit, comprising:

a first metal element, coupled to the coupling element;

a first resistor, embedded in the first metal element;

a second metal element;

a second resistor, embedded in the second metal element; and a BJT (Bipolar Junction Transistor), operated according to a control voltage difference, wherein the BJT has an emitter coupled to the ground element, a base coupled to the second metal element, and a collector coupled to the first metal element.

20. A mobile device, comprising:

a metal mechanism element, having a slot;

a ground element, coupled to the metal mechanism element;

a feeding radiation element, coupled to a signal source, wherein the feeding radiation element extends across the slot;

a coupling element, disposed adjacent to the feeding radiation element, wherein a coupling gap is formed between the feeding radiation element and the coupling element;

a dielectric substrate, wherein the feeding radiation element and the coupling element are disposed on the dielectric substrate; and a switchable circuit, comprising:

a first metal element, coupled to the coupling element;

an inductor, embedded in the first metal element;

a second metal element;

a capacitor, wherein the second metal element is coupled through the capacitor to the ground element; and a diode, coupled between the first metal element and the second metal element, wherein the diode is turned on or turned off according to a control voltage difference;

wherein an antenna structure is formed by the metal mechanism element, the ground element, the feeding radiation element, the coupling element, the dielectric substrate, and the switchable circuit.

* * * * *